United States Patent [19]

Chochrek

[11] Patent Number: 4,762,162

[45] Date of Patent: Aug. 9, 1988

[54] SHADE BRACKETS AND ASSEMBLY

[76] Inventor: Frank S. Chochrek, 95 Eastern Ave., Woburn, Mass. 01801

[21] Appl. No.: 948,324

[22] Filed: Dec. 31, 1986

Related U.S. Application Data

[63] Continuation of Ser. No. 699,631, Feb. 8, 1985, abandoned.

[51] Int. Cl.[4] ..... A47H 1/13

[52] U.S. Cl. ..... 160/323.1; 160/231; 248/266; 248/268; 248/DIG. 9

[58] Field of Search ..... 248/268, 267, 266, 269, 248/270, 271, 272, 264, 262, 263, 254, 251, 252, DIG. 9; 160/223 R, 223 B, 326, 238, 31, 98, 178 B, 23 R

[56] References Cited

U.S. PATENT DOCUMENTS

| | | | |
|---|---|---|---|
| 819,197 | 5/1906 | Agin et al. | 248/266 |
| 1,188,410 | 6/1916 | Burrowes | 160/323 B |
| 1,386,468 | 8/1921 | Goldner | 248/268 |
| 1,792,184 | 2/1931 | Racette | 248/268 |
| 1,809,784 | 5/1931 | Peterson | 248/254 |
| 2,500,706 | 3/1950 | Roshko | 248/267 |
| 2,570,731 | 10/1951 | Susnow | 248/264 X |
| 2,633,322 | 3/1953 | Barr | 248/268 X |
| 2,964,276 | 12/1960 | Silverthorne | 248/264 X |
| 4,136,847 | 1/1979 | Murray | 248/269 X |
| 4,226,396 | 10/1980 | Bowers | 248/268 |
| 4,283,034 | 8/1981 | Sheehan | 248/DIG. 9 X |
| 4,488,653 | 12/1984 | Belokin | 248/DIG. 9 X |

*Primary Examiner*—Ramon O. Ramirez
*Attorney, Agent, or Firm*—Pearson & Pearson

[57] ABSTRACT

When the windows of an old house are being replaced with new window units, and when the windows of a modern house are covered by inside storm windows, the roll up window shades are able to be used by means of a pair of elongated, brackets of thin sheet material which are affixed horizontally to the upper portion of the inside walls of the window frame. Each bracket is bent to form a shoulder and may be covered by a vertical trim piece or side stop so that only the shade supports project into the room with their respective gudgeon hole and spear slot.

3 Claims, 1 Drawing Sheet

SHADE BRACKETS AND ASSEMBLY

This is a continuation of my application Ser. No. 699,631 filed Feb. 8, 1985, now abandoned.

BACKGROUND OF THE INVENTION

Spring biased, roll up window shades have long been known and consist of a flexible fabric shade wound on a wooden roller, the roller having a pin, or pintle, projecting from one end, and a flat spear for winding the spring projecting from the other end. In old houses in need of renovation such spring-wound, roll-up shades have usually been mounted in a pair of brackets each affixed on one of the opposite sides of the channel for the lower sash, near the top of the channels.

In an article entitled 1983 "Window Market Evaluation" which appeared in Remodeling World / August 1983, it is indicated that home remodeling priorities now not only include kitchen and bath, but also energy conserving products such as new windows. It was estimated that 37 million prime replacement windows will be used in the residential market.

When the old windows are replaced with new energy efficient replacement windows, it is necessary to remove the trim pieces and the side stops from the old windows. The trim pieces or side stops have the old window shade brackets mounted thereto.

The old trim pieces, or side stops, usually have to be discarded because they are too narrow when the new wider energy efficient replacement windows are installed. The new replacement windows do not usually come with adjustable built-in window shade brackets to accommodate any new location of the shade.

It has, heretofore, been proposed to provide window shade brackets which are affixed to the upper part of a window frame as in the following patents.

U.S. Pat. No. 2,579,788 to Burns of Dec. 25, 1951, discloses a pair of four walled brackets which entirely enclose the opposite ends of the shade and are quite visible to an observer..

U.S. Pat. No. 2,633,322 to Barr of Mar. 31, 1953, also discloses a plurality of flanges, or walls, and the fixture is affixed to the part of the window frame which faces into the room, so that it can be seen easily by anyone in the room.

U.S. Pat. No. 2,964,276 to Silverthorne of Dec. 13, 1960 provides a pair of generally L shaped brackets forced apart by a threaded telescopable rod for hanging a curtain..

U.S. Pat. No. 3,181,829 to Larsen of May 4, 1965 in FIG. 7 shows a shade support projecting into a room but having a right angular base which is screwed to the window frame.

SUMMARY OF THE INVENTION

In this invention, the spring wound, roll up shade from a discarded window may be saved and quickly and easily mounted on the trim or side stops by means of the pair of brackets described herein.

Each bracket of the pair is formed by an elongated, relatively narrow body of thin sheet material such as metal, having a first straight portion, or base, normally about two and one half inches long and three quarters of an inch in width. The body is bent at right angles for a distance of about one-quarter inch, which is about the thickness of the covering trim piece/of the window frame. It is then again bent at right angles, into parallelism with, and in extension of, the base to form a shade support portion about three quarters of an inch in length terminating in a curved edge or end. One shade support portion has an access slot on the extreme outside edge of the terminal end for the spear of the shade and the other shade support portion has a circular hole for the pintle, or gudgeon of the shade.

The base is formed with a plurality of generally triangular, sharp pointed prongs slit therefrom and bent outwardly at an angle of 90° to pierce into the side walls of the frame.

The base also includes a pattern of nail holes in case affixation by nailing is desired. At least one, and preferably a pair of spaced apart break grooves extend transversely across the base so that the end opposite the shade support end can be shortened where necessary or desirable.

An elongated strip may also be cut away from the top edge of the base so that the top prongs are lower than the shade support portion. Thus, they will not tend to split the top edge of the wood of the side walls of the frame.

DESCRIPTION OF THE PREFERRED EMBODIMENT

Figure 1:
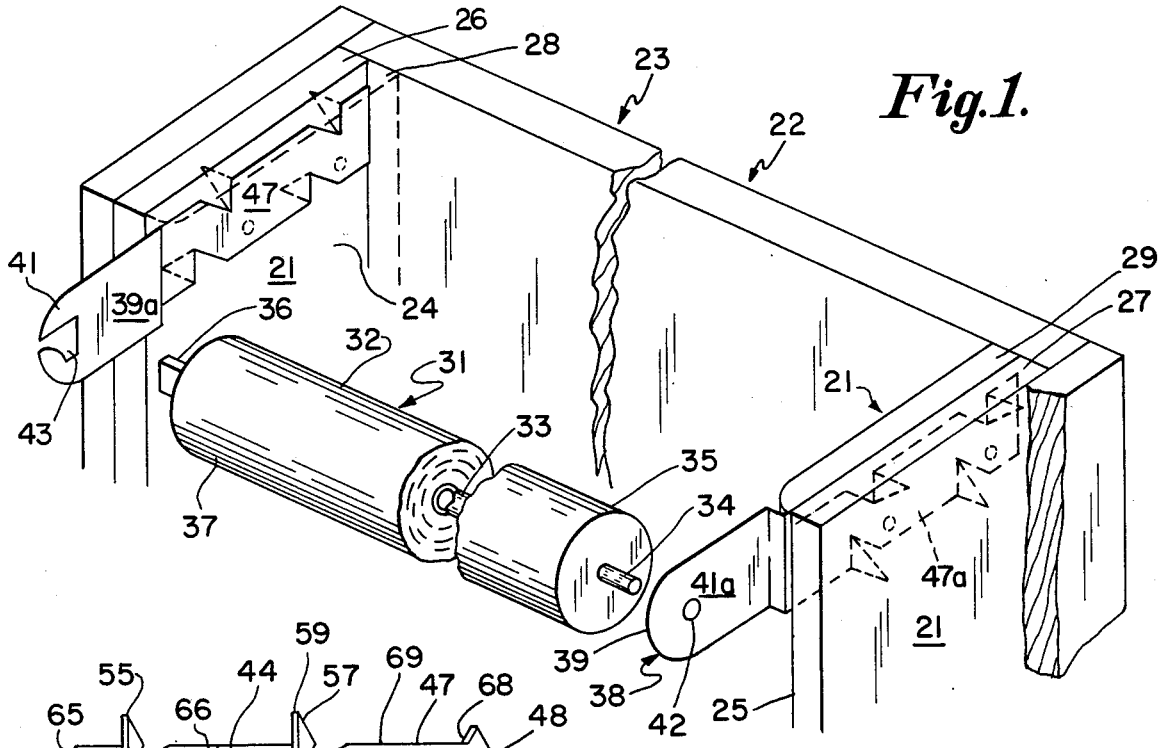
FIG. 1 is a diagrammatic, perspective view, from the inside of a window frame showing the pair of brackets of the invention in place.

In FIG. 1 there is the existing window frame 21, shown diagrammatically after removal of the old window. The frame 21 has an opening 23 for receipt of an energy efficient replacement window 22.

As mentioned above, the spring roll-up window shade of the window unit being replaced is usually discarded with the discarded window and the replacement unit 22 is not provided with shade supporting brackets.

The frame 21 includes a pair of opposite vertical side walls 24 and 25, each having a top edge 26 or 27 and a pair of opposite vertical trim pieces 28 or 29, sometimes called "side stops".

A typical spring wind-up window shade 31 is shown in FIG. 1, the shade 31 having the usual flexible fabric material 32 wound on a core, or roll 33, a gudgeon, or pintle 34, extending axially from one end 35 and the spear 36, of the spring, extending axially from the other end 37.

A pair 38, of shade brackets 39 and 41 are provided, each bracket being identical with the other except for bracket 39 having a gudgeon receiving circular aperture 42, and bracket 41 having a spear receiving slot 43 of known configuration on the extreme outside edge of the terminal end of the bracket 41. Thus, a description of the remainder of one bracket will serve as a description of the opposite bracket of the pair.

Each bracket 39 or 41 includes an elongated, relatively narrow, body 44, preferably about three quarters of an inch in width and formed of thin sheet material 45, such as metal. Each elongated body 44 includes a first straight portion 46, forming a base 47, and extending for about three quarters of its length, for example, about two and one-half inches when the overall length is about three and one quarter inches.

Each elongated body 44 is bent, at 48, at right angles to the base 47, to form a shoulder 49, about one-quarter of an inch in length, and is then bent again at 51, at right angles to the shoulder 49, to form a second straight portion 52, constituting a shade support 53,in parallelism with, and in extension of the first, elongated, straight portion 46. The shade support 53 is preferably about three quarters of an inch in length and terminates in a curved edge 54.

As stated above, each shade support 53 of each bracket 39 or 41 is provided with either a gudgeon hole 42 or a spear slot 34, or spear 36 of a shade 31.

The first elongated straight portion 46, or base 47,of each bracket 39 or 41, is provided with a plurality of generally triangular prongs such as 55, 56, 57 and 58, each slit from the material 45 of the body 44, and bent at right angles thereto and each terminating in a sharp point 59 so that each base 47 may be affixed to the vertical side wall 24 or 25 by piercing thereinto.

The first elongated straight portion 46, or base 47, of each bracket 39, or 41, is also provided with a pattern of nail holes such as at 61, 62, 63 and 64 so that each base may be nailed to the vertical side walls 24 and 25, if desired.

Each base 47 is also provided with at least one groove 65, and preferably with a pair of spaced apart, transversely extending such grooves 65 and 66, proximate the end 67 thereof, opposite to the shade support 53 and shoulder 49, which are break-off grooves to enable the brackets to be shortened when desired or necessary.

Figure 2:
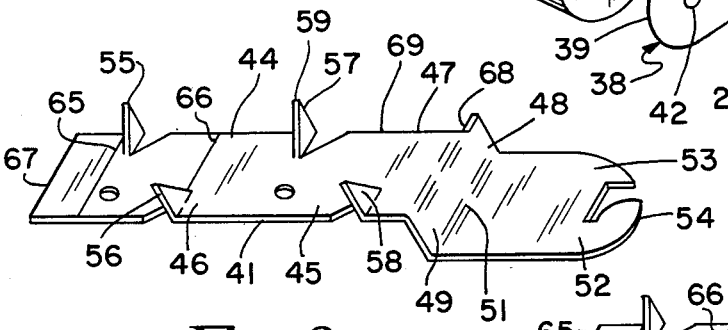
FIG. 2 is a perspective view of the spear receiving bracket.
Figure 3:
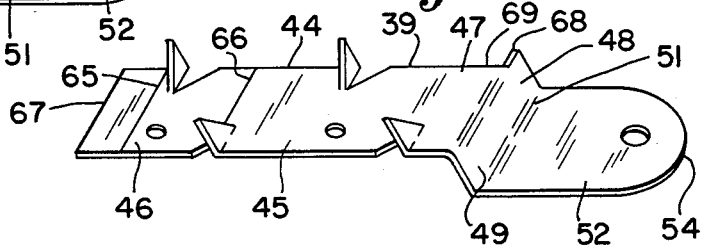
FIG. 3 is a view similar to FIG. 2 of the gudgeon receiving bracket.
Figure 4:
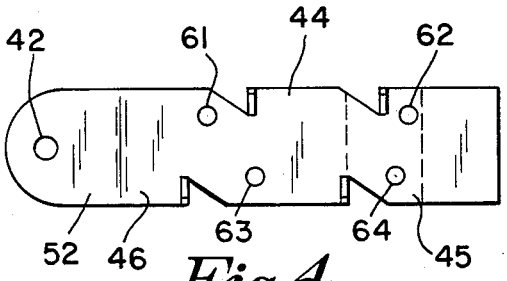
FIG. 4 is a rear elevation, of the gudgeon receiving bracket.
Figure 6:
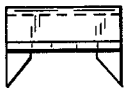
FIG. 6 is an end elevation of the gudgeon receiving bracket.
Figure 5:
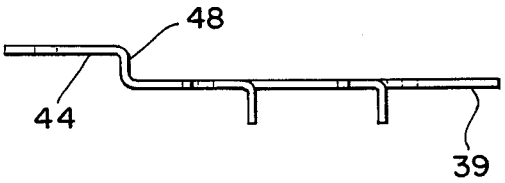
FIG. 5 is a side edge elevation of the gudgeon receiving bracket.
Figure 7:
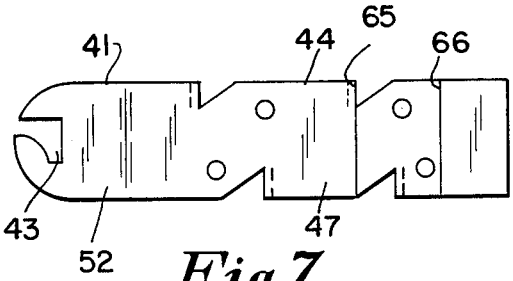
FIG. 7 is a rear elevation of the spear receiving bracket.

Preferably, also each base 47 has an elongated cut-out such as 68 extending along the upper edge 69 where an elongated strip of the sheet material 45 has been cut away. (FIGS. 2 and 3) This lowers the triangular prongs along the upper edge of the base so that they do not tend to split the top edges 26 and 27 of the side walls 24 and 25.

As shown in FIG. 1, each bracket 39 or 41 may have its base 47 affixed to the upper portion of a side wall 24 or 25, by prongs or nails, so that it extends horizontally with each shade support 53 extending from the frame 21 into the room and each base 47 covered by a trim piece 28 or 29, and the shade 31 from the discarded window supported in the usual manner between the shade supports 53 of the brackets.

In the case of interior storm windows, which are sheets of plastic, full height of a window, and held in place by magnetic strips, along each opposite side edge, the existing roll up window shades are enclosed in the resulting air pocket and cannot be raised or lowered without removing the inside storm windows. The elongated brackets 39 and 41 may be mounted along the inside walls of the window frame to extend horizontally into the room, through an orifice in the storm window, so that the roll up shade can be removed from its usual brackets and mounted in the brackets 39 and 41 for use while the storm windows are in place. Because of the thin material of the brackets, and the snap-off grooves 65 and 66, the brackets can be shortened to fit inside the fixed strips of the magnetic storm windows so that the shoulders of the brackets position the shade supports at the correct distance apart to accommodate the shade.

Preferably the brackets 39 and 41 are installed about one-quarter of an inch below the header, onto the window frame 21, and the front edges **39*a* and 41*a* protrude at least one-eighth of an inch beyond the edge of the trim pieces, or side stops 28 and 29 with the 90° bend facing inward. The trim pieces, or side stops 28 and 29 cover the bases 47 and 47*a* of the brackets 39 and 41**, and are then nailed onto the frame. The shade supports are easily bent left or right for proper shade fit.

I claim:

1. A shade saver assembly comprising:

a replacement window unit of the type forming a complete unit fitting a window opening, including a frame with opposite vertical sidewalls and opposite trim pieces each lining one of the opposite vertical walls;

a roll-up window shade having a gudgeon at one end and a spring wind-up spear at the other end;

a pair of shade brackets, each having an elongated, relatively narrow body of thin sheet metal with a first straight portion about three quarters of its length forming a base, and having a plurality of sharp pointed prongs extending outwardly at right angles therefrom toward the said walls and piercing into one of said opposite vertical walls, each said elongated body being bent inwardly at right angles toward the other body for a distance of about one-quarter inch and each said elongated body then being bent again at right angles into parallelism with and in, extension of said base to form a cantilevered shade support with a curved terminal edge;

an elongated strip along an upper edge of the base of each said bracket is cut away so that the prongs along the remaining upper edge are unlikely to split the top edge of the inner vertical walls of said frame;

one said cantilevered support having an open slot on the outside edge of the terminal end and the other said support having a hole at the terminal end for said gudgeon;

each said bracket fitting under one of said trim pieces at right angles thereto and so that only the shade support portions thereof are visible.

2. A shade saver assembly as specified in claim 1 wherein:

each said bracket includes a plurality of nail holes in the base thereof and includes at least two transversely extending brake-off grooves in the base thereof proximate the end of said body opposite to the end forming said shade supports.

3. A shade saver assembly as specified in claim 1 wherein:

said thin sheet metal of said body is bendable so that said shade supports may be bent left or right after installation for final shade fit.

* * * * *